United States Patent [19]

Bender

[11] 3,947,082

[45] Mar. 30, 1976

[54] TOOTH CONFIGURATION FOR AN ELECTRICAL CONNECTOR

[75] Inventor: Louis R. Bender, Elizabeth, N.J.

[73] Assignee: Thomas & Betts Corporation, Elizabeth, N.J.

[22] Filed: Dec. 16, 1974

[21] Appl. No.: 533,209

[52] U.S. Cl. ..... 339/97 R

[51] Int. Cl.[2] ..... H01R 9/08

[58] Field of Search ..... 339/97 C, 96, 95 R, 97 R, 339/97 P, 98, 276 R, 276 T

[56] References Cited

UNITED STATES PATENTS 3,736,627 6/1973 Sosinski ..... 339/98 X

*Primary Examiner*—Gerald A. Dost

*Attorney, Agent, or Firm*—David Teschner; Jesse Woldman

[57] ABSTRACT

An improved tooth configuration for the contact surface of an electrical connector comprises a rearwardly sloping generally V-shaped upper surface peripherally circumscribed by upstanding side and rear walls communicating therewith along a sharp continuous edge. The apex of the V-shape is located at the communication of the obliquely disposed side walls and may have a height less than the height of the side walls at their distal ends. The teeth may be arranged in a series of parallel rows wherein the teeth in one row may be either similarly or oppositely oriented with respect to the teeth in an adjacent row.

8 Claims, 7 Drawing Figures

TOOTH CONFIGURATION FOR AN ELECTRICAL CONNECTOR

BACKGROUND OF THE INVENTION

1. Field of the Invention

The invention is directed to the field of electrical connectors and principally to an improved tooth form for the contact surface thereof.

2. Description of the Prior Art

Prior art electrical connectors have been provided with toothed contact surfaces which serve both as insulators and oxide piercing means and to increase the engagement between the connector and the conductor enclosed therewithin. Special tooth forms which have been developed to improve the characteristics of electrical connectors are exemplified in U.S. Pat. No. 3,514,527 issued May 26, 1970 to T. L. C. Kuo and assigned to the assignee of the instant invention; and U.S. Pat. No. 3,549,786 issued Dec. 22, 1970 to T. L. C. Kuo and assigned to the assignee of the instant invention. These tooth forms, although adequate in many applications, comprise relatively widely spaced teeth proportioned generally to accept a particular range of wire sizes and are of limited usefulness where both large and small diameter conductors are to be simultaneously connected within a single wire receiving cavity or ferrule of a connector employing such prior art tooth forms, since the smaller conductor may tend to lie within the recesses or channels existing between adjacent teeth and thus fail to be securely engaged or contacted by such teeth. Additionally, the teeth of such prior art connectors are generally disposed over the interior surface of the connector in a specific pattern commensurate with the placement of conductors along a preferred axis of disposition so that conductors oriented in a direction offset from the preferred axis may fail to be properly engaged by such teeth. In the case where insulation or oxide covered conductors are employed, such limitation may severely limit the integrity and reliability of the final connection, leading either to premature failure of the connection or erratic performance thereof.

SUMMARY OF THE INVENTION

The invention overcomes the limitations and difficulties noted above with respect to prior art devices by providing an improved tooth pattern and tooth form for electrical connectors which is more reliable and versatile than such prior art devices. The teeth may be arranged over the interior surface of the connector in either similarly or dissimilarly oriented, closely spaced parallel rows, each tooth having a generally V-shaped or chevron-like configuration in plan view and comprising a sloping upper surface circumscribed by side and rear walls which communicate therewith along a sharp continuous edge adapted to pierce and bite into the conductive portion of one or more conductors placed within the connector and secured thereto as by crimping or the like. The upper surface may have a concave curvature in either or both of two mutually perpendicular directions and may have a height above the base surface of the connector substantially equal to the thickness of the base material. In one specific embodiment, the ends of the teeth have a height greater than the central portion thereof to increase the length and number of cutting edges available when employed, for example, with relatively small conductors. The tooth pattern and configuration may be coordinated to present a substantially continuous line of cutting or piercing edges irrespective of orientation over the surface of the connector so as to eliminate the need for preferential placement of the conductors over such surface. It is therefore an object of this invention to provide an improved tooth configuration for electrical connectors.

It is another object of this invention to provide an improved insulation and oxide piercing connector.

It is a further object of this invention to provide a means for increasing the area of contact of a toothed electrical connector.

It is still another object of this invention to provide an electrical connector having a tooth configuration arranged to provide a series of continuous cutting edges.

It is yet another object of this invention to provide a means for increasing the length of the cutting edge of a tooth of an electrical connector.

It is yet a further object of this invention to coordinate an improved tooth form and tooth pattern for electrical connectors for increased efficiency of contact.

It is still a further object of this invention to provide an electrical connector having a toothed surface arranged to operate with equal effectiveness and reliability over a wide range of conductor sizes.

It is still another object of this invention to provide an electrical connector having an improved tooth pattern comprising selectively formed teeth arranged to eliminate the need for preferential orientation in use.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
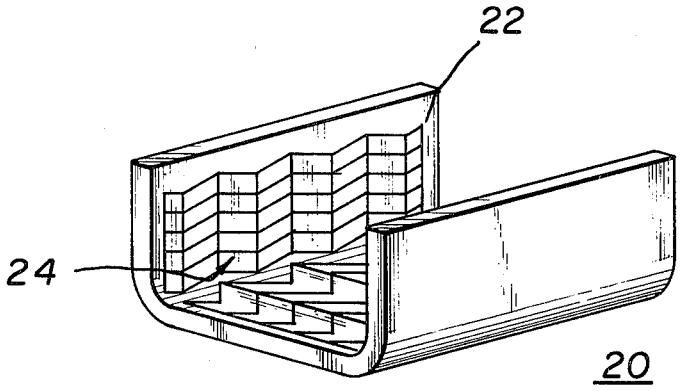
FIG. 1 is a perspective view of an electrical connector employing an improved tooth configuration constructed in accordance with the concepts of the invention.
Figure 2:
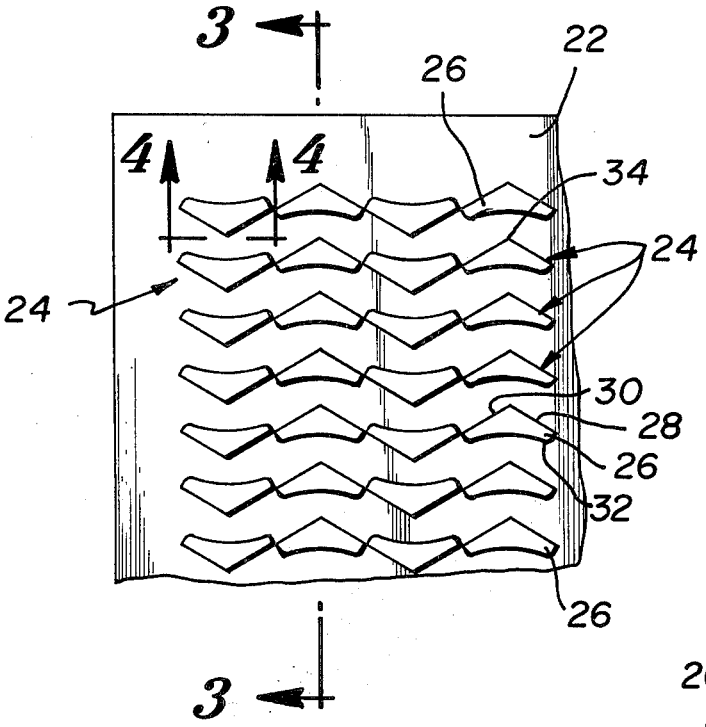
FIG. 2 is an enlarged fragmentary top plan view showing the details of the tooth form illustrated in FIG. 1.
Figure 3:
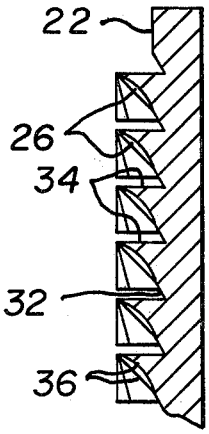
FIG. 3 is a fragmentary sectional view taken along the line 3—3 in FIG. 2.
Figure 4:
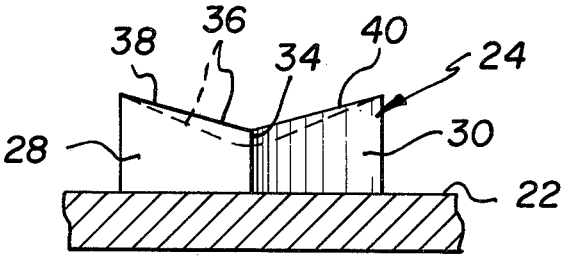
FIG. 4 is a fragmentary front elevational view, partly in section, taken along the line 4—4 in FIG. 2.
Figure 5:
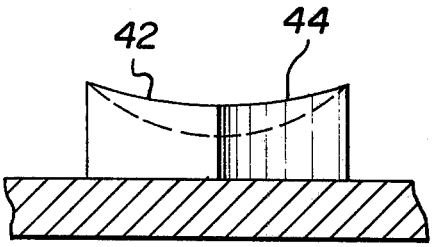
FIG. 5 is a fragmentary front elevational view, partly in section, of a further embodiment of an improved tooth form constructed in accordance with the concepts of the invention.
Figure 6:
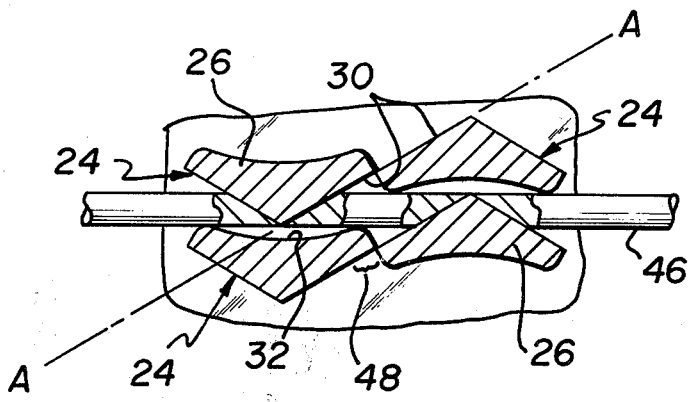
FIG. 6 is a fragmentary top plan view, partly cut away and partly in section, of a portion of the toothed connector of FIG. 1, as engaged with a relatively small conductor.

Turning now to FIGS. 1, 2, 3, 4, and 6 there is shown an electrical connector 20 having an interior surface 22 over which are disposed a series of teeth 24 constructed in accordance with the concepts of the invention. As shown in the plan view of FIG. 2, the teeth 24 are arranged generally in a regular pattern more commonly referred to as a herringbone pattern comprising a series of closely spaced, parallel rows each having similarly oriented teeth 24 while the teeth of one row are oppositely oriented with respect to the teeth of an adjacent row. Each tooth 24 has a generally V-shaped configuration and comprises a selectively contoured sloping upper surface 26 bounded by a first side wall 28, a second side wall 30, and a rear wall 32. The first and second side walls 28 and 30, respectively, define the arms of the V and communicate with one another along a sharp vertical edge 34 at the apex of the V. The side walls 28 and 30 and the rear wall 32 communicate with the upper surface 26 along a continuous sharp edge 32 (FIG. 3) circumscribing the upper surface 26, the side walls 28 and 30 being disposed generally normal to the surface 22, and the rear wall 32 preferably sloping downwardly from the upper surface 26 of the tooth 24 at an oblique angle to the connector surface 22. As further illustrated in FIGS. 3 and 4, the upper surface 26 has a generally concave configuration essentially in two directions, that is, along an axis extending from the apex 34 towards the rear wall 32, as best seen in FIG. 3, and along an axis extending between the terminating ends of the side walls 28 and 30 as best seen in FIG. 4. Furthermore, the height of the tooth 24 at its apex 34 is shown in FIG. 4 as being less than its height adjacent its ends, which arrangement has been found to be advantageous for engagement with relatively small diameter wires. It should be understood, however, that the side walls 28 and 30 of the tooth 24 may be proportioned to have a uniform height throughout their length without significantly altering the characteristics thereof. Additionally, each of the side walls 28 and 30 may have an upper edge 38, 40, (FIG. 4) respectively, sloping linearly from their respective ends towards the apex 34, or, alternatively, may be proportioned to slope curvilinearly between these two points, as shown at 42 and 44 in FIG. 5. As shown in greater detail in FIG. 6, the pattern of the teeth 24 of the embodiment illustrated in FIG. 2 is arranged to insure that the respective sidewalls of adjacently disposed teeth lie in a common plane and along a common axis indicated by the line A—A which is shown as coincident with the side walls 30 of the upper teeth 24 as viewed in FIG. 6, so that a conductor such as 46 which is placed horizontally across the pattern, substantially as shown, is caused to engage at least one or more of the sharp bounding edges of the upper surface 26. The spacing between the teeth 24 in each row is further selectively arranged so that the apex 34 of each tooth lies within the bounds of the rear wall 32 of an adjacent tooth in the same row, as defined by an axis drawn between the terminating ends of the rear wall. Furthermore, the rows of teeth are spaced from one another in such manner as to insure that the terminating ends of adjacently disposed teeth lie within a common narrow region, conductor placed upon the above described pattern will be engaged by at least one or more of the sharp bounding edges of the upper surface 26 regardless of its orientation, so that, upon closure of the connector about such conductor, the outer surface of the conductor, regardless of its diameter, will be contacted by a sufficient number of teeth 24 to insure adequate and reliable interengagement therebetween.

Figure 7:
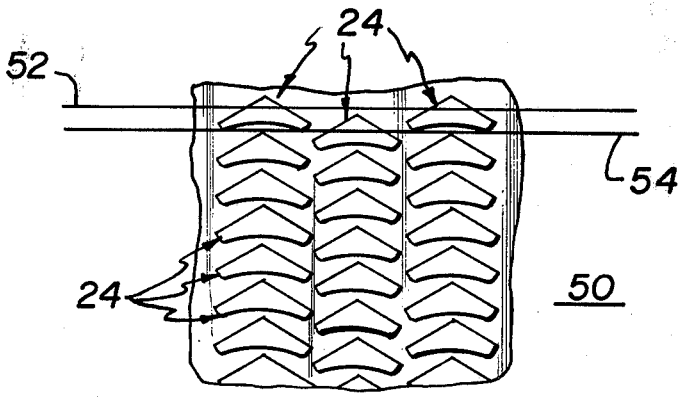
FIG. 7 is a fragmentary top plan view of a further embodiment of a tooth pattern for an electrical connector constructed in accordance with the concepts of the invention.

Turning now to FIG. 7, there is shown a further embodiment of a tooth pattern 50 constructed in accordance with the concepts of the invention. As illustrated, the pattern 50 includes a plurality of similarly oriented teeth 24 arranged in closely spaced parallel rows where the teeth 24 of a particular row are axially offset from the teeth 24 in an adjacent row. For example, as viewed in FIG. 7, the upper teeth 24 of the first and third rows lie along an axis indicated by the numeral 52 while the upper tooth 24 of the second row lies along an axis 54 selectively offset from the axis 52 so that, in the case where all of the teeth of the pattern are uniformly spaced from one another, the teeth of alternating rows will lie intermediate the teeth of adjacent rows. Accordingly, a conductor such as 46 disposed over the pattern 50 will also be insured contact with a given number of teeth regardless of its orientation, as the connector is crimped thereabout. It will, of course, be readily apparent to those skilled in the art that combination of the patterns illustrated in FIG. 2 and FIG. 7 may be provided over the interior surface of the connector, or one or the other of such pattern may be provided within selected areas of the interior surface of the connector without departing from the spirit of the invention and within the concepts herein disclosed. It should also be appreciated that although only one form of connector 20 has been shown, the disclosed invention may be readily adapted to other configurations such as splice connectors, terminal connectors, and other like devices having a wire receiving portion or ferrule for engagement with either an insulated or non-insulated conductor.

It should be further noted that each of the teeth 24 are formed preferably from the base material of the connector, as by skiving and the like, and may have a maximum height approximately equal to the thickness of the base material without unduly weakening the connector.

The embodiments of the invention in which an exclusive property or privilege is claimed are defined as follows:

1. In an electrical connector of the type having a wire receiving portion having an interior surface, and a plurality of upstanding teeth disposed over said interior surface, the improvement comprising: each of said teeth having a generally V-shaped configuration in plan view, and comprising an upper surface circumscribed by a first side wall, a second side wall, and a rear wall, said upper surface communicating with said first and second side walls and said rear wall along a sharp edge, said first and second side walls being disposed generally normal to said interior surface and at an oblique angle with respect to one another, said first and second side walls communicating with one another along an edge defining the apex of said V-shape, said upper surface sloping downwardly from said apex to said rear wall and towards said interior surface, said upper surface having a generally concave curvature in a plan extending across said V-shape between the terminating ends of said first and said second side walls.

2. The improvement as defined in claim 1 wherein said upper surface has a generally concave curvature in two planes including a first plane extending from said apex of said V-shape towards said rear wall, and a second plane extending across said V-shape between the terminating ends of said first and said second side walls.

3. The improvement as defined in claim 1 wherein the height of said upper surface at said apex of said V-shape is lower than the height of said upper surface at the terminating ends of said V-shape.

4. The improvement as defined in claim 1 wherein each of said first and said second side walls is generally planar.

5. The improvement as defined in claim 1 wherein said rear wall is generally curvilinear.

6. The improvement as defined in claim 5 wherein each of said side walls is generally planar, and said upper surface has a generally concave curvature in a plane extending from said apex of said V-shape towards said rear wall.

7. The improvement as defined in claim 5 wherein each of said side walls is generally planar, and said upper surface has a generally concave curvature in a plane extending across said V-shape between the terminating ends of said first and said second side walls.

8. The improvement as defined in claim 7 wherein said upper surface has a generally concave curvature in a plane extending from said apex of said V-shape towards said rear wall.

* * * * *